US006513177B1

(12) United States Patent
Beveridge

(10) Patent No.: US 6,513,177 B1
(45) Date of Patent: Feb. 4, 2003

(54) WATER RECYCLING HAND WASHING BASIN ASSEMBLY

(76) Inventor: Karen S. Beveridge, HC 65, Box 96A, Wauneta, NE (US) 69045

( * ) Notice: Subject to any disclaimer, the term of this patent is extended or adjusted under 35 U.S.C. 154(b) by 0 days.

(21) Appl. No.: 10/093,456

(22) Filed: Mar. 8, 2002

(51) Int. Cl.[7] ..... E03C 1/16
(52) U.S. Cl. ..... 4/624
(58) Field of Search ..... 4/624–627, 602, 4/603

(56) References Cited

U.S. PATENT DOCUMENTS 1,836,854 A * 12/1931 Leland ..... 4/624
2,310,617 A * 2/1943 Conner ..... 4/624
2,616,095 A * 11/1952 Stuckey
2,810,916 A * 10/1957 Cullen ..... 4/624
5,293,654 A * 3/1994 Castwall et al. ..... 4/602
6,298,502 B1 * 10/2001 Brown ..... 4/626

FOREIGN PATENT DOCUMENTS

CH 227941 * 7/1943 ..... 4/624

* cited by examiner

*Primary Examiner*—Charles R. Eloshway

(57) ABSTRACT

A water recycling hand washing basin assembly for providing a relatively portable self-contained multi-station device to facilitate hand washing. The water recycling hand washing basin assembly includes a main structure forming an annular basin surrounding a hub portion. Water collected in the basin passes through a filter or series of filters into a reservoir. A pump assembly is provided to permit pumping of the water in the reservoir to a water outlet.

8 Claims, 4 Drawing Sheets

WATER RECYCLING HAND WASHING BASIN ASSEMBLY

BACKGROUND OF THE INVENTION

1. Field of the Invention

The present invention relates to hand washing basins and more particularly pertains to a new water recycling hand washing basin assembly for providing a relatively portable self-contained multi-station device to facilitate hand washing.

2. Description of the Prior Art

The use of hand washing basins is known in the prior art. U.S. Pat. No. 3,722,007 describes a group washing station that is connected to an outside water supply. Another type of hand washing basin is U.S. Pat. No. 4,698,860 having a multi-person setup and soap dispensers incorporated into sprayheads. U.S. Pat. No. 4,769,863 teaches a portable single person hand washing unit with manual pumping. U.S. Pat. No. 4,765,003 discloses a portable washing unit with foot pumps and low water indicators to alert users to find another washing unit. U.S. Pat. No. 5,687,434 discloses a portable stand-alone sink that utilizes a two tank system for dispensing fresh water and collecting waste water. U.S. Pat. No. Des. 401,679 shows an ornamental design for a portable sink.

While these devices fulfill their respective, particular objectives and requirements, the need remains for a multi-station self-contained water recycling hand washing unit.

SUMMARY OF THE INVENTION

The present invention meets the needs presented above by providing a filtration system and pump system for cycling water through a water outlet and basin from a water reservoir to permit hand washing by multiple persons over a period of time with minimal need to refresh the water supply.

Still yet another object of the present invention is to provide a new water recycling hand washing basin assembly that recycles water to maximize useful time of the system.

Even still another object of the present invention is to provide a new water recycling hand washing basin assembly that utilizes manually operated foot pumping such that a power supply is not required.

To this end, the present invention generally comprises a main structure forming an annular basin surrounding a hub portion. Water collected in the basin passes through a filter or series of filters into a reservoir. A pump assembly is provided to permit pumping of the water in the reservoir to a water outlet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
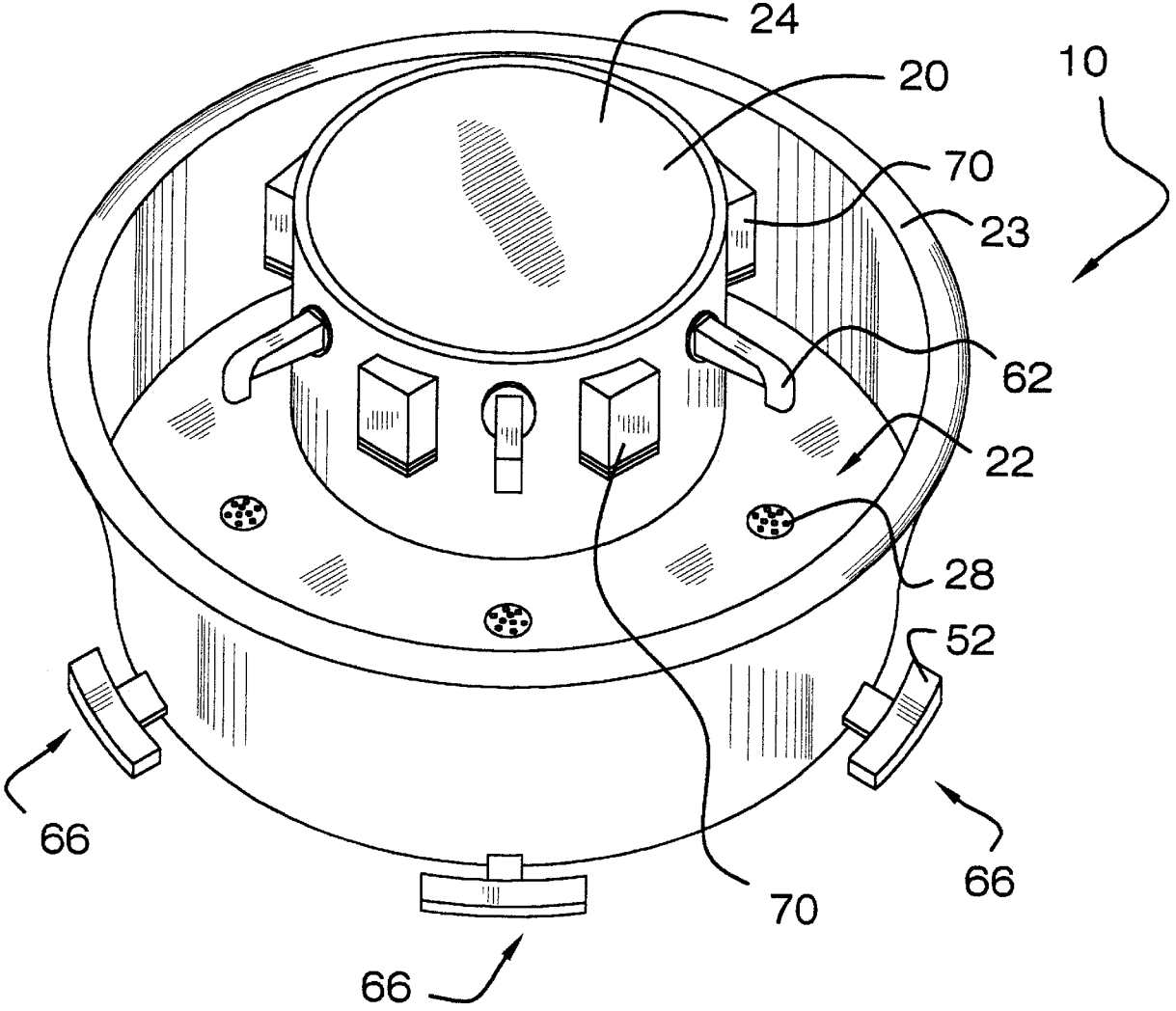
FIG. 1 is a perspective view of a new water recycling hand washing basin assembly according to the present invention.
Figure 2:
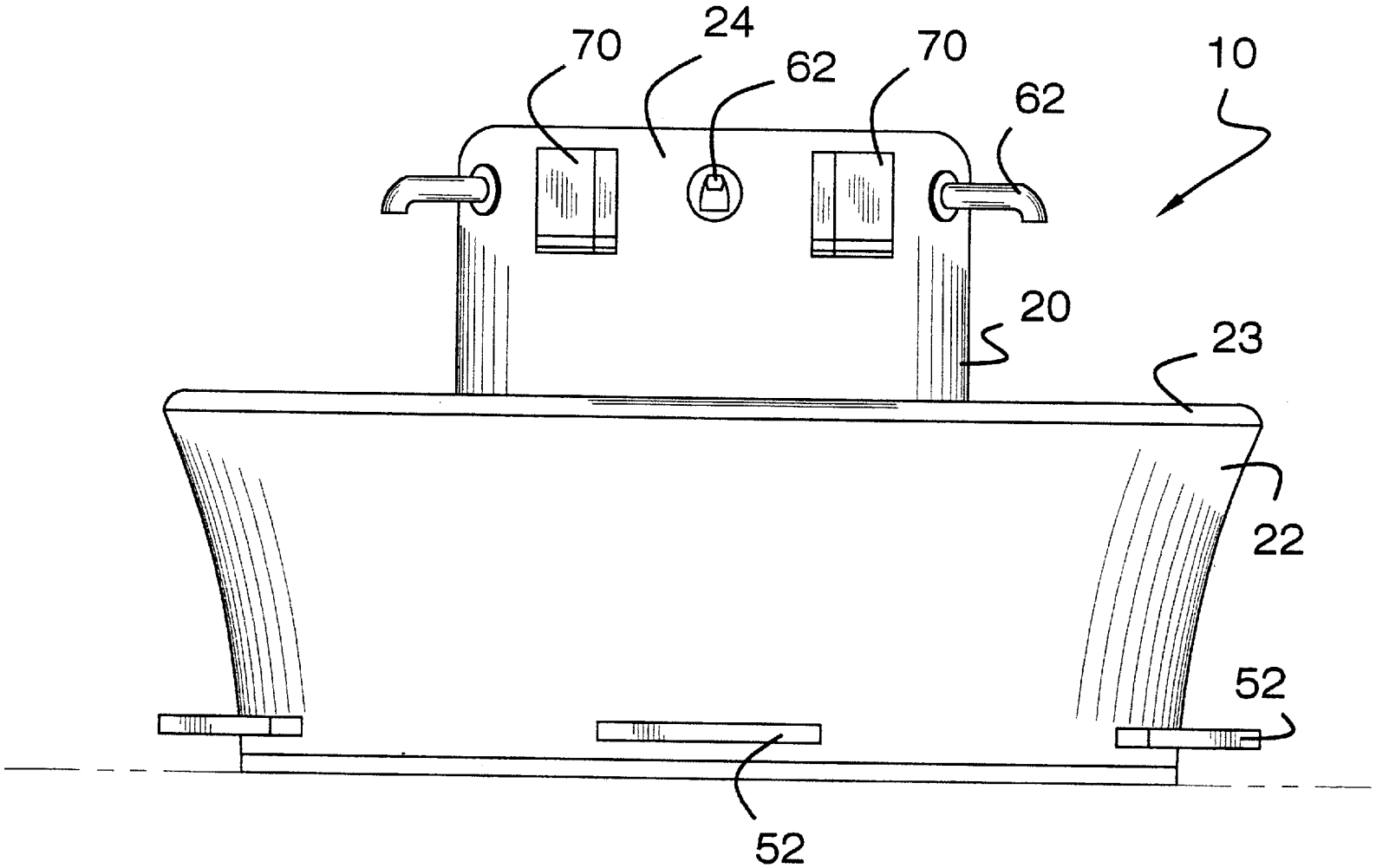
FIG. 2 is a side view of the present invention.
Figure 3:
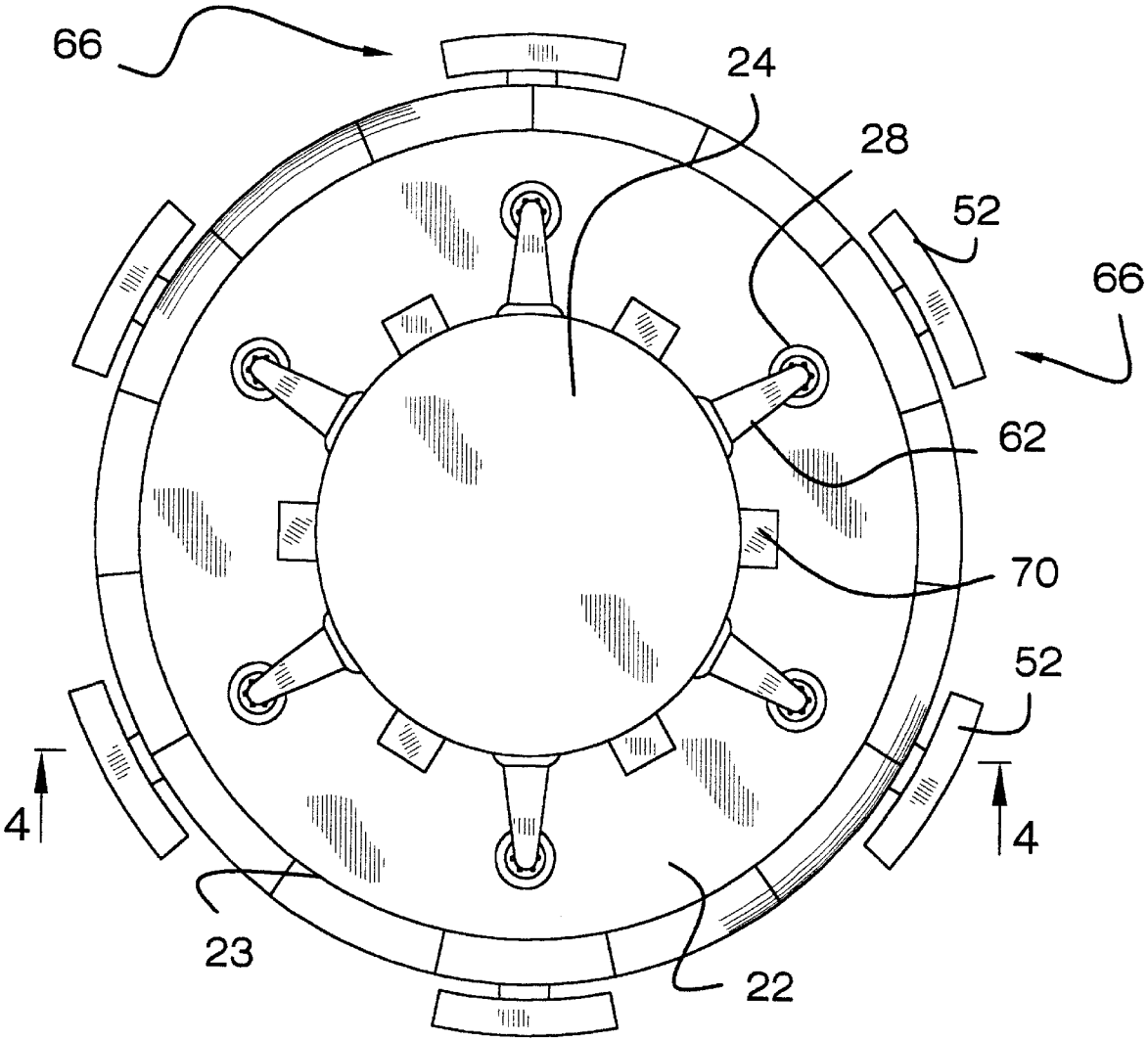
FIG. 3 is a top view of the present invention.
Figure 4:
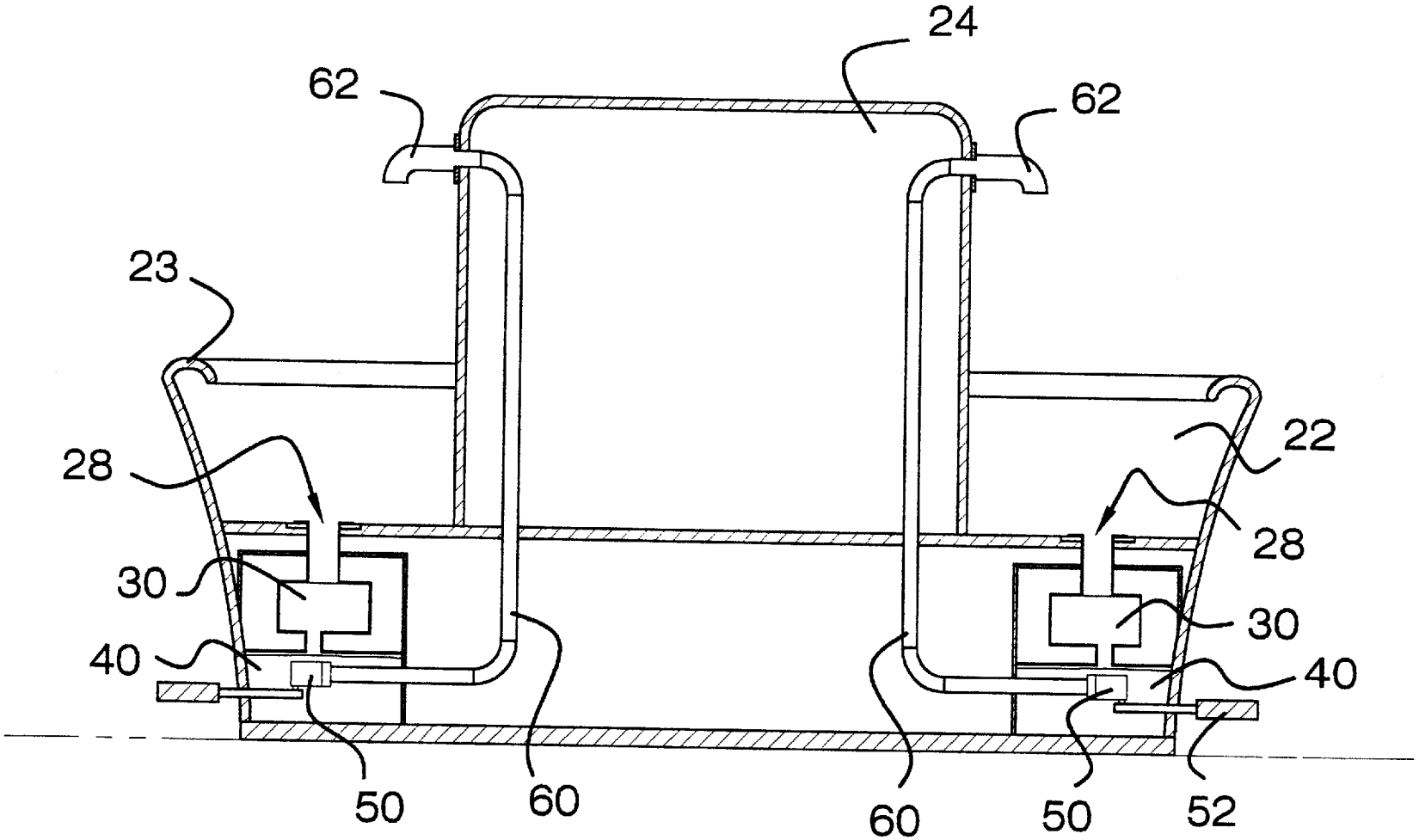
FIG. 4 is a cross-sectional view of the present invention taken along line 4—4 of FIG. 3.

With reference now to the drawings, and in particular to FIGS. 1 through 4 thereof, a new water recycling hand washing basin assembly embodying the principles and concepts of the present invention and generally designated by the reference numeral 10 will be described.

As best illustrated in FIGS. 1 through 4, the water recycling hand washing basin assembly 10 generally comprises a main structure 20 forming a basin 22 and a hub portion 24. Typically, the main structure will be constructed of a lightweight but sturdy plastic to permit portability of the main structure 20.

A drain 28 is positioned in the basin 22 for receiving water collected in the basin 22. A filter assembly 30 is coupled to the drain 28 whereby water received by the drain 28 passes through the filter assembly 30. A water reservoir tank 40 is coupled to the filter assembly 30 for collecting water passing through the filter assembly 30.

A pump assembly 50 is provided for pumping water from the water reservoir tank 40. A dispersal conduit 60 is provided for receiving water pumped from the water reservoir tank 40.

A water outlet 62 is coupled to the hub portion 24. The water outlet 62 is in environmental communication with the dispersal conduit 60 whereby water passing through the dispersal conduit 60 passes through the water outlet 62. The water outlet 62 is positioned above the basin 22 whereby the basin 22 collects water dispensed from the water outlet 62.

A soap dispensing assembly 70 is coupled to the main structure 20. Typically, the soap dispensing assembly 70 is positioned on the hub portion 24 adjacent to the water outlet 62.

In an embodiment, the basin 22 is annular and extends around the hub portion 24 for forming a plurality of hand washing stations 66 around the hub portion 24. Each of the hand washing stations 66 includes it's own associated drain 28, pump assembly 50, water outlet 62, filter assembly 30, and soap dispensing assembly 70.

In a preferred embodiment, the pump assembly 50 includes a manually operable foot pedal 52 coupled to the main structure 20 for dispensing water through the water outlet 62 when the foot pedal 52 is depressed by a user.

The basin 22 includes an inwardly curved upper lip 23 to minimize loss of water from splashing of water out of the basin 22 over the upper lip 23.

In use, a person pumps the foot pedal to dispense water through the water outlet to wet their hands. The soap dispensing assembly is then used to provide soap and then the hands can be rinsed by once again using the foot pedal. Water passing over the hands is collected in the basin and passes through the drain. The water then passes into the filter assembly which may incorporate one or several filtering steps. The filtered water is then passed from the filtering assembly into the water reservoir tank where it becomes available to be pumped out again through the water outlet.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water recycling hand washing basin assembly comprising:

a main structure forming a basin and a hub portion;

a drain positioned in said basin for receiving water collected in said basin;

a filter assembly coupled to said drain whereby water received by said drain passes through said filter assembly;

a water reservoir tank coupled to said filter assembly for collecting water passing through said filter assembly;

a pump assembly for pumping water from said water reservoir tank;

a dispersal conduit for receiving water pumped from said water reservoir tank;

a water outlet coupled to said hub portion, said water outlet being in environmental communication with said dispersal conduit whereby water passing through said dispersal conduit passes through said water outlet, said water outlet being positioned above said basin whereby said basin collects water dispensed from said water outlet;

a soap dispensing assembly coupled to said main structure; and said basin having an inwardly curved upper lip having a peripheral edge turning downwardly such that an apex of an interior surface of said basin is positioned offset and above said peripheral edge of said basin to minimize loss of water from splashing of water out of said basin over said upper lip.

2. The water recycling hand washing basin assembly of claim 1, further comprising:

said basin being annular, said basin extending around said hub portion for forming a plurality of hand washing stations around said hub portion.

3. The water recycling hand washing basin assembly of claim 2, further comprising:

said drain being one of a plurality of drains;

said water outlet being one of a plurality of water outlets; and each of said hand washing stations including an associated one of said drains and water outlets.

4. The water recycling hand washing basin assembly of claim 3, further comprising:

said soap dispensing assembly being one of a plurality of soap dispensing assemblies; and each said hand washing station including an associated one of said soap dispensing assemblies.

5. The water recycling hand washing basin assembly of claim 3, further comprising:

said pump assembly being one of a plurality of pump assemblies; and each said hand washing station including an associated one of said pump assemblies.

6. The water recycling hand washing basin assembly of claim 1, further comprising:

said pump assembly being manually operated.

7. The water recycling hand washing basin assembly of claim 6, further comprising:

said pump assembly including a foot pedal coupled to said main structure for dispensing water through said water outlet when said foot pedal is depressed by a user.

8. A water recycling hand washing basin assembly comprising:

a main structure forming a basin and a hub portion;

a drain positioned in said basin for receiving water collected in said basin;

a filter assembly coupled to said drain whereby water received by said drain passes through said filter assembly;

a water reservoir tank coupled to said filter assembly for collecting water passing through said filter assembly;

a pump assembly for pumping water from said water reservoir tank;

a dispersal conduit for receiving water pumped from said water reservoir tank;

a water outlet coupled to said hub portion, said water outlet being in environmental communication with said dispersal conduit whereby water passing through said dispersal conduit passes through said water outlet, said water outlet being positioned above said basin whereby said basin collects water dispensed from said water outlet;

a soap dispensing assembly coupled to said main structure;

said basin being annular, said basin extending around said hub portion for forming a plurality of hand washing stations around said hub portion;

said drain being one of a plurality of drains;

said water outlet being one of a plurality of water outlets, each of said hand washing stations including an associated one of said drains and water outlets;

said pump assembly being manually operated;

said pump assembly including a foot pedal coupled to said main structure for dispensing water through said water outlet when said foot pedal is depressed by a user;

said soap dispensing assembly being one of a plurality of soap dispensing assemblies;

each said hand washing station including an associated one of said soap dispensing assemblies;

said pump assembly being one of a plurality of pump assemblies;

each said hand washing station including an associated one of said pump assemblies; and said basin having an inwardly curved upper lip having a peripheral edge turning downwardly such that an apex of an interior surface of said basin is positioned offset and above said peripheral edge of said basin to minimize loss of water from splashing of water out of said basin over said upper lip.

* * * * *